US010568390B2

(12) United States Patent
Yoshida

(10) Patent No.: US 10,568,390 B2
(45) Date of Patent: Feb. 25, 2020

(54) OUTSOLE STRUCTURE FOR SHOES AND CLEATED SHOE USING SAME

(71) Applicant: Mizuno Corporation, Osaka (JP)

(72) Inventor: Yohei Yoshida, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 57 days.

(21) Appl. No.: 15/778,321

(22) PCT Filed: Dec. 5, 2016

(86) PCT No.: PCT/JP2016/086109
§ 371 (c)(1),
(2) Date: May 23, 2018

(87) PCT Pub. No.: WO2017/110440
PCT Pub. Date: Jun. 29, 2017

(65) Prior Publication Data

US 2018/0343979 A1 Dec. 6, 2018

(30) Foreign Application Priority Data

Dec. 24, 2015 (JP) ..... 2015-252239

(51) Int. Cl.
*A43C 15/02* (2006.01)
*A43B 23/22* (2006.01)
(Continued)

(52) U.S. Cl.
CPC ..... *A43C 15/02* (2013.01); *A43B 13/122* (2013.01); *A43B 13/41* (2013.01); *A43B 23/22* (2013.01);
(Continued)

(58) Field of Classification Search
CPC ..... A43C 13/41; A43C 13/12; A43C 15/16; A43B 5/02; A43B 5/00; A43B 23/22; A43B 13/41; A43B 13/12
(Continued)

(56) References Cited

U.S. PATENT DOCUMENTS 2,362,497 A * 11/1944 Moore ..... A43B 7/142 36/17 R
2,585,588 A * 2/1952 Krick ..... A43B 23/22 36/19.5
(Continued)

FOREIGN PATENT DOCUMENTS

DE 19608488 A1 9/1996
EP 3056105 A1 8/2016
(Continued)

*Primary Examiner* — Ted Kavanaugh
(74) *Attorney, Agent, or Firm* — Troutman Sanders LLP; Daniel Sharpe

(57) ABSTRACT

A shoe outsole structure includes: a first outsole component made of a deformable soft resin material and configured to entirely support a plantar surface spreading from a forefoot to a hindfoot; and a second outsole component integrally formed on top of the first outsole component, made of a hard resin material which has a higher rigidity than the first outsole component, and configured to support a region, of the plantar surface, which is continuous from a rear portion, of the forefoot, located rearward of metatarsophalangeal joints to the hindfoot.

12 Claims, 11 Drawing Sheets

(51) Int. Cl.

| | |
|---|---|
| ***A43B 13/41*** | (2006.01) |
| ***A43B 13/12*** | (2006.01) |
| *A43B 13/37* | (2006.01) |
| *A43B 7/14* | (2006.01) |
| *A43B 13/22* | (2006.01) |
| *A43B 23/17* | (2006.01) |
| *A43B 13/14* | (2006.01) |
| *A43C 15/16* | (2006.01) |
| *A43B 5/02* | (2006.01) |

(52) U.S. Cl.
CPC ..... *A43B 5/02* (2013.01); *A43B 7/1445* (2013.01); *A43B 13/141* (2013.01); *A43B 13/223* (2013.01); *A43B 13/37* (2013.01); *A43B 23/17* (2013.01); *A43C 15/16* (2013.01)

(58) Field of Classification Search
USPC ..... 36/103, 102, 107, 108, 126, 128, 129, 36/67 R, 67 A, 76 R
See application file for complete search history.

(56) References Cited

U.S. PATENT DOCUMENTS 5,185,944 A * 2/1993 Okajima ..... A43B 23/042 12/146 C
5,452,526 A * 9/1995 Collins ..... A43B 1/0072 36/108
6,205,683 B1 3/2001 Clark et al.
8,713,819 B2 * 5/2014 Auger ..... A43B 5/02 36/30 R
9,526,297 B2 * 12/2016 Davis ..... A43B 1/0009
2002/0148142 A1 * 10/2002 Oorei ..... A43B 5/00 36/129
2002/0184793 A1 * 12/2002 Sato ..... A43B 13/12 36/30 R
2003/0070320 A1 4/2003 Ellis, III
2004/0134096 A1 7/2004 Ellis, III
2014/0075779 A1 3/2014 Bruce et al.

FOREIGN PATENT DOCUMENTS

JP 2002101905 A 4/2002
JP 4020879 B2 10/2007
JP 5591420 B1 8/2014
JP 2015529139 A 10/2015

* cited by examiner

OUTSOLE STRUCTURE FOR SHOES AND CLEATED SHOE USING SAME

CROSS REFERENCE TO RELATED PATENT APPLICATION

This application is a U.S. National Stage of International Patent Application No. PCT/JP2016/086109, filed 5 Dec. 2016, which claims the benefit of Priority to Japanese Application No. 2015-252239, filed 24 Dec. 2015. The entire contents of which are hereby incorporated in their entireties by reference herein.

TECHNICAL FIELD

The present invention relates to a shoe outsole structure and a cleated shoe using the shoe outsole structure.

BACKGROUND ART

A shoe outsole structure including two resin materials that have different rigidities and are integral with each other has been known from Patent Document 1, for example.

Specifically, Patent Document 1 discloses a shoe sole including spikes and formed by integrating a first resin and a second resin which is higher in Young's modulus than the first resin together. The first resin is provided to correspond to a region continuous from the metatarsophalangeal joints (the so-called MP joints) to the tiptoe of a forefoot. The second resin includes a first band portion having the shape of a band and extending along the hallux located at the medial side of a foot, and a second band portion having the shape of a band and extending along the fifth toe located at the lateral side of the foot. The first band portion extends to correspond to a region from a rear end of the forefoot to a site of the proximal condyle of the proximal phalanx of the hallux. On the other hand, the second band portion extends to correspond to a region from the rear end of the forefoot to a site of the proximal condyle of the proximal phalanx of the fifth toe.

CITATION LIST

Patent Documents

Patent Document 1: Japanese Patent No. 4020879

SUMMARY OF THE INVENTION

Technical Problem

Meanwhile, it is required for cleated shoes for use in sports in which a player needs to move instantaneously, such as soccer, rugby, American football, and baseball, to have the following characteristics: an area of the shoe corresponding to a region of a wearer's foot which includes the metatarsophalangeal joints and is continuous from a substantial center in the longitudinal direction of the forefoot to the front end of the forefoot, allows the wearer to easily bend his/her joints (in particular, the metatarsophalangeal joints) of the forefoot during exercise; whereas another area of the shoe corresponding to a region of the wear's foot which is continuous from a rear portion, of the forefoot, located rearward of the metatarsophalangeal joints to the hindfoot, reduces an impact applied to the foot at the moment of an instantaneous motion such as a change in direction, and stabilizes, inside the shoe, the region continuous from the rear portion of the forefoot to the hindfoot.

However, in the shoe sole of Patent Document 1, since each of the first and second band portions extends over the metatarsophalangeal joints and reaches the site of the proximal condyle of the associated proximal phalanx, dorsiflexion occurs mainly in a tiptoe region when the wearer kicks. This limits the bending at the metatarsophalangeal joints of the forefoot, while efficiently generating propulsion for running. That is, it is difficult for cleated shoes including the shoe soles of Patent Document 1 to stabilize a region continuous from a rear portion, of the forefoot, located rearward of the metatarsophalangeal joints to the hindfoot and to allow the metatarsophalangeal joints in the forefoot to be bent flexibly. This creates a risk that repetition of instantaneous motions in a game such as a soccer game may apply physical stresses to a wearer's foot (especially, a vicinity of the metatarsophalangeal joints).

In view of the foregoing background, it is therefore an object of the present invention to provide a shoe outsole structure which allows the joints, in particular, the metatarsophalangeal joints to be easily bent in a region continuous from a substantial center of the forefoot in a longitudinal direction to a front end of the forefoot, and which stabilizes a region continuous from a rear portion of the forefoot located rearward of the metatarsophalangeal joints to the hindfoot.

Solution to the Problem

In order to achieve the above object, a first aspect of the present invention is directed to a shoe outsole structure for supporting a plantar surface of a wearer. The shoe sole structure includes: a first outsole component made of a deformable soft resin material and configured to entirely support the plantar surface spreading from a forefoot to a hindfoot; and a second outsole component integrally formed on top of the first outsole component, made of a hard resin material which has a higher rigidity than the first outsole component, and configured to support a region, of the plantar surface, which is continuous from a rear portion, of the forefoot, located rearward of metatarsophalangeal joints to the hindfoot.

According to the first aspect, in an area corresponding to a region which includes metatarsophalangeal joints and is continuous from a substantial center in the longitudinal direction of the forefoot to a front end of the forefoot, the first outsole component made of a deformable soft resin material allows the joints of the forefoot (especially the metatarsophalangeal joints) to be bent flexibly during exercise. On the other hand, in an area corresponding to a region continuous from a rear portion, of the forefoot, located rearward of the metatarsophalangeal joints to the hindfoot, the second outsole component made of a hard resin material which has a higher rigidity than the first outsole portion can reduce an impact applied to the foot at the time of an instantaneous motion such as a change in direction and stabilize the region from the rear portion of the forefoot to the hindfoot inside the shoe, while maintaining a sufficient flexural rigidity. The configuration in which the second outsole component is integrally formed on top of the first outsole portion makes it possible to obtain both the advantages for the region including metatarsophalangeal joints and continuous from the substantial center in the longitudinal direction to the front end of the forefoot, and the advantages for the region from the rear portion, of the forefoot, located rearward of the metatarsophalangeal joints to the hindfoot.

A second aspect of the present invention is an embodiment of the first aspect. In the second aspect, a front portion of the second outsole component is located in an area corresponding to a region which is continuous from a substantial center in a longitudinal direction of first to fifth metatarsals to distal condyles of the first to fifth metatarsals, and extends from a left side to a right side of the first outsole component so as to support the first to fifth metatarsals.

According to the second aspect, while the first outsole component maintains a state where especially the metatarsophalangeal joints are easily bent, the second outsole component made of a hard resin material which has a high rigidity can stabilize the first to fifth metatarsals inside the shoe.

A third aspect of the present invention is an embodiment of the first or second aspect. In the third aspect, on a bottom surface of the first outsole component, a plurality of first studs are arranged dispersedly in a forefoot area, and in plan view, a front end of the second outsole component overlaps with at least one of the first studs which is located rearward of the metatarsophalangeal joints.

According to the third aspect, the first studs contribute to enhancement of ground-gripping capability. Further, the front end of the second outsole component overlaps with at least one first stud located rearward of the metatarsophalangeal joints in plan view. Therefore, the boundary between the first and second outsole components is situated above the first stud that is located rearward of the metatarsophalangeal joints. That is, the boundary between the first and second outsole components overlaps with the first stud which can be deformed to very limited extent by bending. This makes it difficult for stresses to concentrate at the boundary between the first and second outsole components having different rigidities. As a result, the second outsole component is less likely to peel off the first outsole component at this boundary.

A fourth aspect of the present invention is an embodiment of the first or second aspect. In the fourth aspect, a pair of left and right ribs extending in a longitudinal direction is provided in an area of the first outsole component corresponding to a region which is continuous from the portion, of the forefoot, located rearward of the metatarsophalangeal joints to a midfoot, and each rib is constituted by a portion, of the second outsole component, which penetrates the first outsole component so as to project from a bottom surface of the first outsole component.

According to the fourth aspect, the pair of left and right ribs constituted by portions of the second outsole component having a high rigidity contributes not only to reduction of the weight of the whole outsole structure, but also to enhancement of the flexural rigidity of the area corresponding to the region from the rear portion, of the forefoot, located rearward of the metatarsophalangeal joints to the midfoot. As a result, a physical stress applied to the region of a wearer's foot from a rear portion, of the forefoot, located rearward of the metatarsophalangeal joints to the midfoot can be reduced.

A fifth aspect of the present invention is an embodiment of the fourth aspect. In the fifth aspect, each of the pair of left and right ribs has a central portion in a longitudinal direction positioned near proximal condyles of first to fifth metatarsals.

It is generally known that: a player playing soccer or any other sports reduces his/her running speed mainly using his/her forefoot and twist the forefoot to change the running direction; and repetition of this motion causes physical stresses to accumulate in the vicinity of the proximal condyles of the metatarsals (in particular, of the proximal condyle of the fifth metatarsal). According to the fifth aspect, each of the left and right ribs has its central position in the longitudinal direction positioned near the proximal condyles of the first to fifth metatarsals. This contributes to further enhancement of the flexural rigidity in an area corresponding to the vicinity of the proximal condyles of the first to fifth metatarsals. As a result, the physical stresses applied to the vicinity of the proximal condyles of the metatarsals (in particular, of the proximal condyle of the fifth metatarsal) can be reduced.

A sixth aspect of the present invention is an embodiment of the fourth or fifth aspect. In the sixth aspect, on a bottom surface of the first outsole component, a plurality of first studs are arranged dispersedly in a forefoot area, while a plurality of second studs are arranged dispersedly in a hindfoot area, and in plan view, each of the pair of left and right ribs has a front end overlapping with an associated one of the first studs that is located rearward of the metatarsophalangeal joints and in a rearmost portion of the forefoot area, and a rear end overlapping with an associated one of the second studs that is located in a foremost portion of the hindfoot area.

According to the sixth aspect, the first and second studs contribute to enhancement of ground-gripping capability. In addition, the left and right ribs are continuous with the first studs that are located rearward of the metatarsophalangeal joints and in the rearmost portion of the forefoot area, and with the second studs that are located in the foremost portion of the hindfoot area. This contributes to further enhancement of the flexural rigidity of the midfoot area in particular.

A seventh aspect of the present invention is an embodiment of any one of the first to sixth aspects. In the seventh aspect, a counter portion rises from left, right, and rear sides of the first outsole component so as to cover a heel, and from a rear portion of the second outsole component, a heel support portion extends upward to have a top end positioned lower than a top end of the counter portion so as to support a lower portion of the heel.

According to the seventh aspect, the heel support portion having a high rigidity can stabilize the lower portion of the heel. Furthermore, the counter portion, which has a low rigidity and of which the top end is positioned above the heel support portion, softly holds the periphery of the heel. This reduces a risk of appearance of pain in the wearer's foot during exercise.

An eighth aspect of the present invention is directed to a cleated shoe including the shoe outsole structure according to any one of the first to seventh aspects.

The cleated shoe according to the eighth aspect provides the same advantage as in any one of the first to seventh aspects.

Advantages of the Invention

As can be seen from the foregoing, according to the present invention, an area corresponding to a region which includes the metatarsophalangeal joints and is continuous from a substantial center in the longitudinal direction to the front end of the forefoot allows a wearer to easily bend his/her joints (in particular, the metatarsophalangeal joints) of the forefoot during exercise; whereas another area corresponding to a region from a rear of the forefoot located rearward of the metatarsophalangeal joints to the hindfoot can reduce an impact applied to the foot at the time of an instantaneous motion and stabilize the region from the rear portion of the forefoot to the hindfoot inside the shoe, while maintaining a sufficient flexural rigidity.

DESCRIPTION OF EMBODIMENTS

Embodiments of the present invention will now be described in detail below with reference to the drawings. Note that the following description of the embodiments is merely an example in nature, and is not intended to limit the scope, applications, or use of the present invention.

FIGS. 1 to 11 show a shoe outsole 1 according to an embodiment of the present invention. Cleated shoes including the outsoles 1 are for sports such as soccer, rugby, American football, and baseball, in which a player needs to move instantaneously. The drawings show the shoe outsole 1 for a left foot only, as an example. Since the shoe outsole for a right foot is symmetrical to that for the left foot, only the outsole for the left foot will be described in the following description, and the description of the outsole for the right foot will be omitted herein. In the following description, the expressions "above," "upward," "on a/the top of," "below," "under," and "downward," represent the vertical positional relationship between respective components of the outsole 1. The expressions "front," "fore," "forward, "rear," "back," "hind," "behind," and "backward" represent the positional relationship in the longitudinal direction between respective components of the outsole 1. The expressions "left (side)" "leftward," "right (side)" and "rightward" represent the positional relationship in the width direction between respective components of the outsole 1. In addition, in the following description, the expression "proximal condyle(s) of metatarsal(s)" of a foot of a human body indicates the condyle(s), of a metatarsal(s), closer to a trunk (i.e., the body apart from the limbs and the head), whereas the expression "a distal condyle(s) of a metatarsal(s)" indicates the condyle (s), of a metatarsal(s), farther from the trunk.

Figure 1:
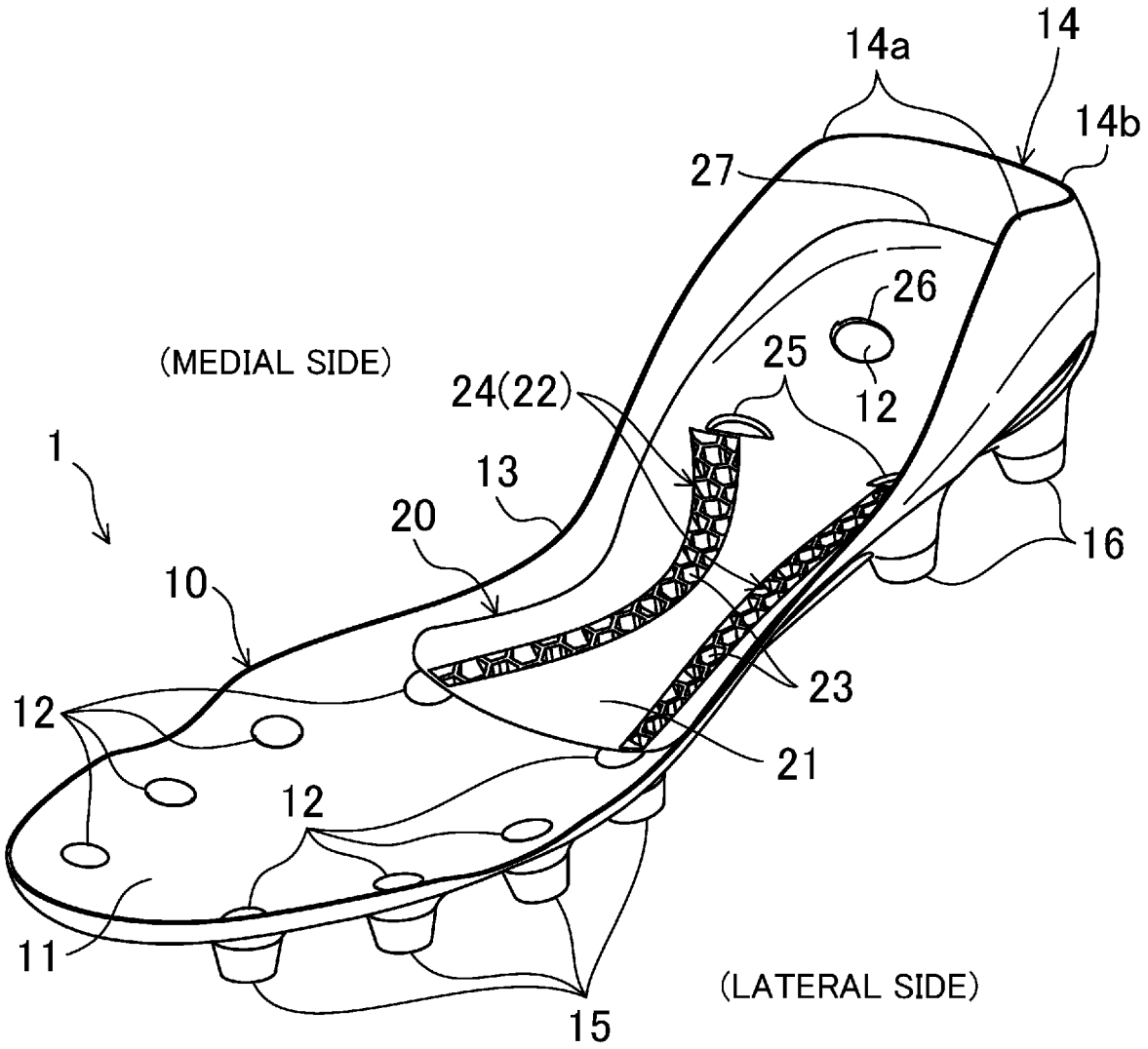
FIG. 1 is a perspective view of a shoe outsole according to an embodiment of the present invention.
Figure 2:
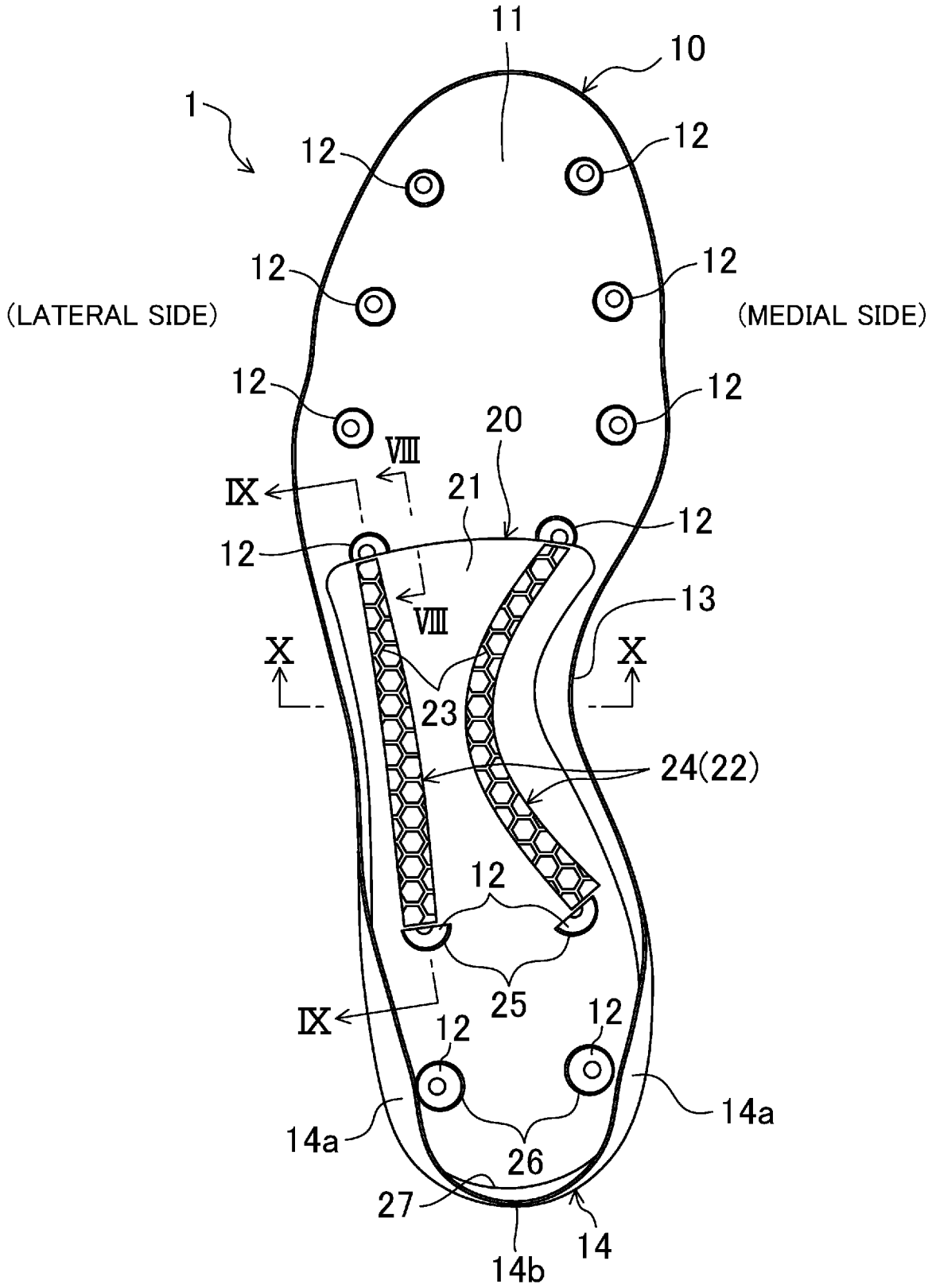
FIG. 2 is a plan view of the shoe outsole according to the embodiment of the present invention.
Figure 3:
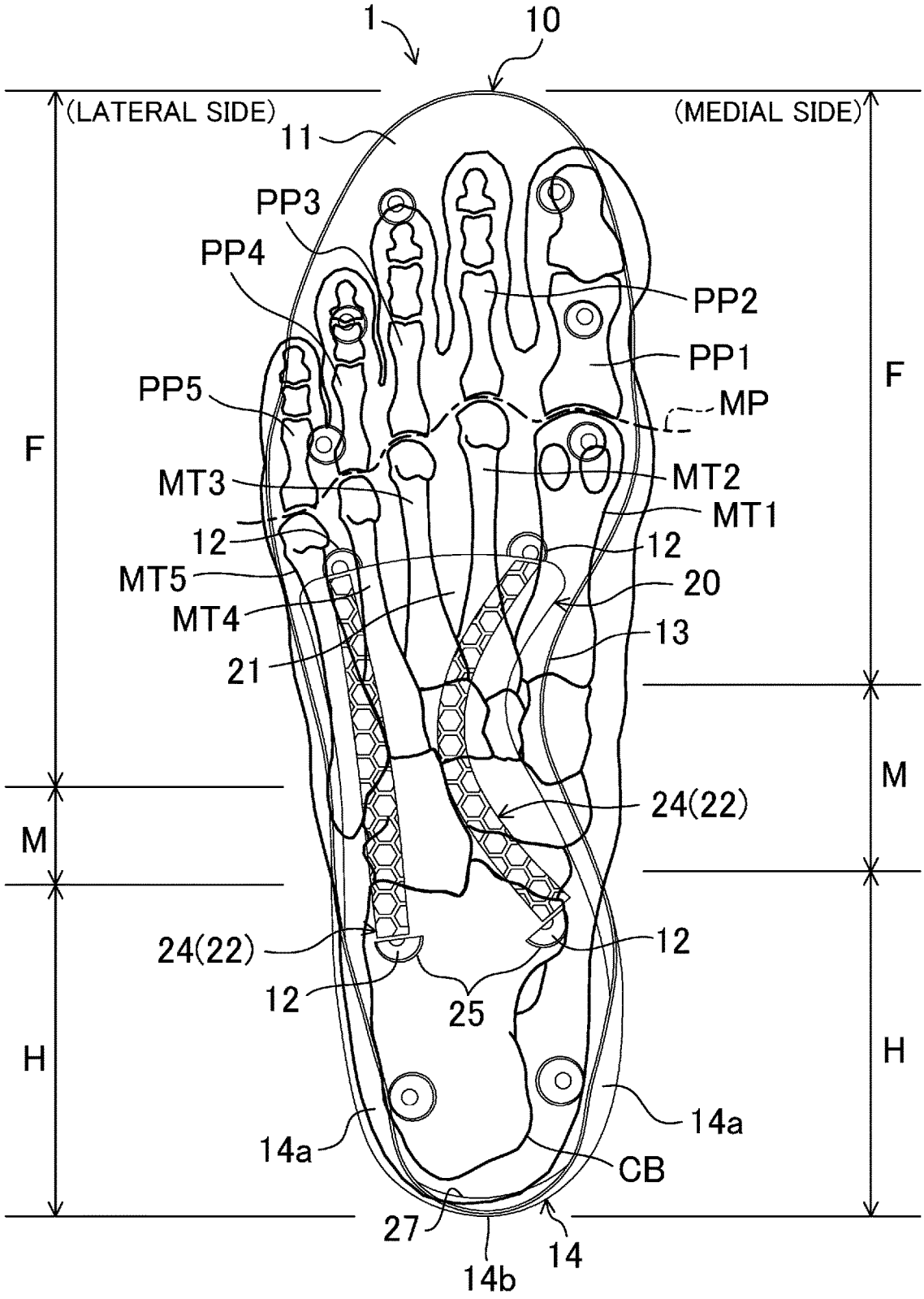
FIG. 3 is a plan view schematically showing a positional relationship between the outsole and the skeleton structure of a foot.
Figure 4:
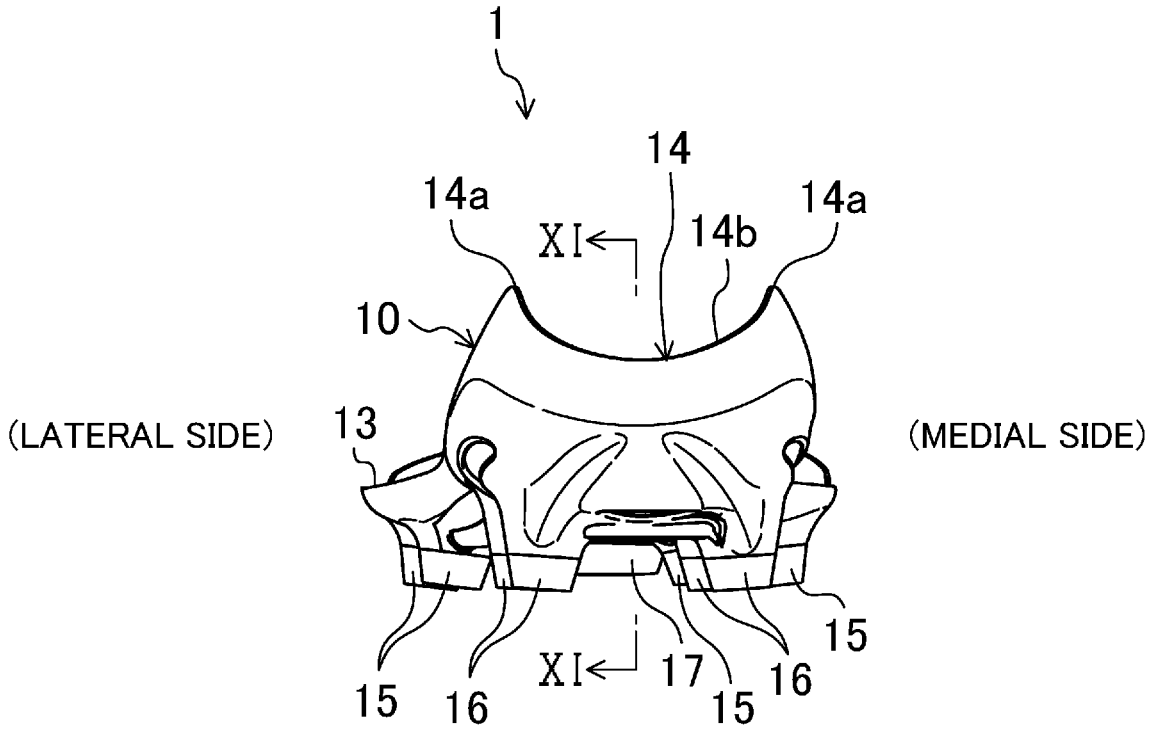
FIG. 4 is a back view of the shoe outsole according to the embodiment of the present invention.

As shown in FIGS. 1 to 3, the shoe outsole 1 is configured to support a plantar surface of the wearer. The outsole 1 includes a first outsole component 10 configured to support the entire plantar surface, from a forefoot F to a hindfoot H. For example, the first outsole component 10 is made of a soft resin material such as a nylon-based elastomer, and has the shape of a thin plate. Specifically, the first outsole component 10 has a relatively low flexural rigidity, and is deformable in response to an external force.

Figure 9:
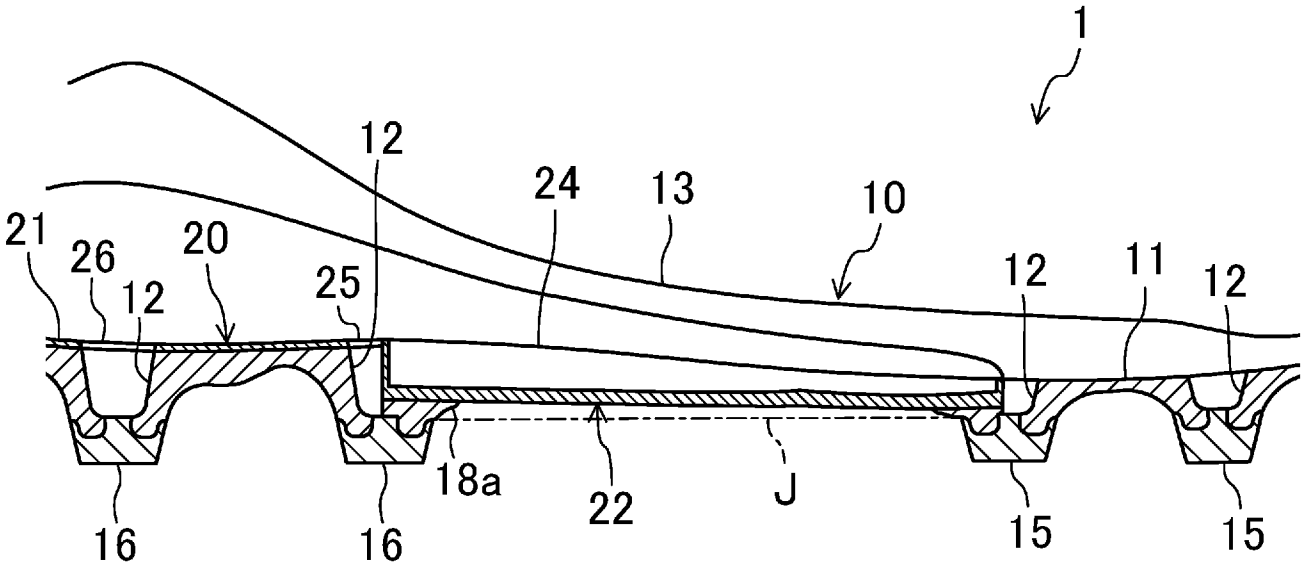
FIG. 9 is a cross-sectional view taken along line IX-IX of FIG. 2.

Further, on a surface (top surface) of the first outsole component 10, a first planta-contact surface 11 is provided which is configured to contact a region, of the plantar surface, which includes the metatarsophalangeal joints MP and is continuous from a substantial center in the longitudinal direction of the forefoot F to the front end of the forefoot F. Note that the metatarsophalangeal joints MP are amphiarthroses which are located between the distal condyles of the metatarsals MT1-MT5 and the proximal condyles of the proximal phalanxes PP1-PP5, and which connect the metatarsals MT1-MT5 to the proximal phalanxes PP1-PP5. Furthermore, as shown in FIG. 9, on the surface of the first outsole component 10, a plurality of round recesses 12, 12, . . . are formed as recesses at positions corresponding to first and second studs 15, 16 which will be described later.

As shown in FIGS. 1 to 5, a rise portion 13 rises and extends along the front, left, and right portions of the periphery of the first outsole component 10. An upper (not shown) of the shoe is fixed, at the outer surface of its lower portion, to the inner surface of the rise portion 13 and the inner surface of a counter portion 14 which will be described later.

As shown in FIGS. 1 to 5, the counter portion 14 is provided to a rear portion of the first outsole component 10. The counter portion 14 is continuous with, and extends further upward than, the rise portion 13. The counter portion 14 is shaped to cover left, right, and rear sides of the calcaneus CB (heel). The counter portion 14 is curved such that its inner surface is concave outwardly. As can be seen from FIG. 11, the counter portion 14 includes, at its left and right parts, side wall portions 14*a*, 14*a* which project upward to have its top end positioned above the calcaneus CB, and are configured to cover the left and right sides of the calcaneus CB. Further, the counter portion 14 includes, at its rear part, a rear wall portion 14*b* which is continuous with the side wall portions 14*a*, 14*a* and configured to cover the rear side of the calcaneus CB. The rear wall portion 14*b* has its top end reaching a vicinity of the top end of the calcaneus CB, and is curved in an arc shape so as to bulge rearward as it goes down. Thus, the counter portion 14 is configured to tightly hold the left and right sides of the heel with the side wall portions 14*a*, 14*a* so as to limit leftward and rightward twisting motions of the calcaneus CB, and to hold the rear side of the heel with the rear wall portion 14*b* to the extent that bending of the ankle is allowed.

Figure 5:
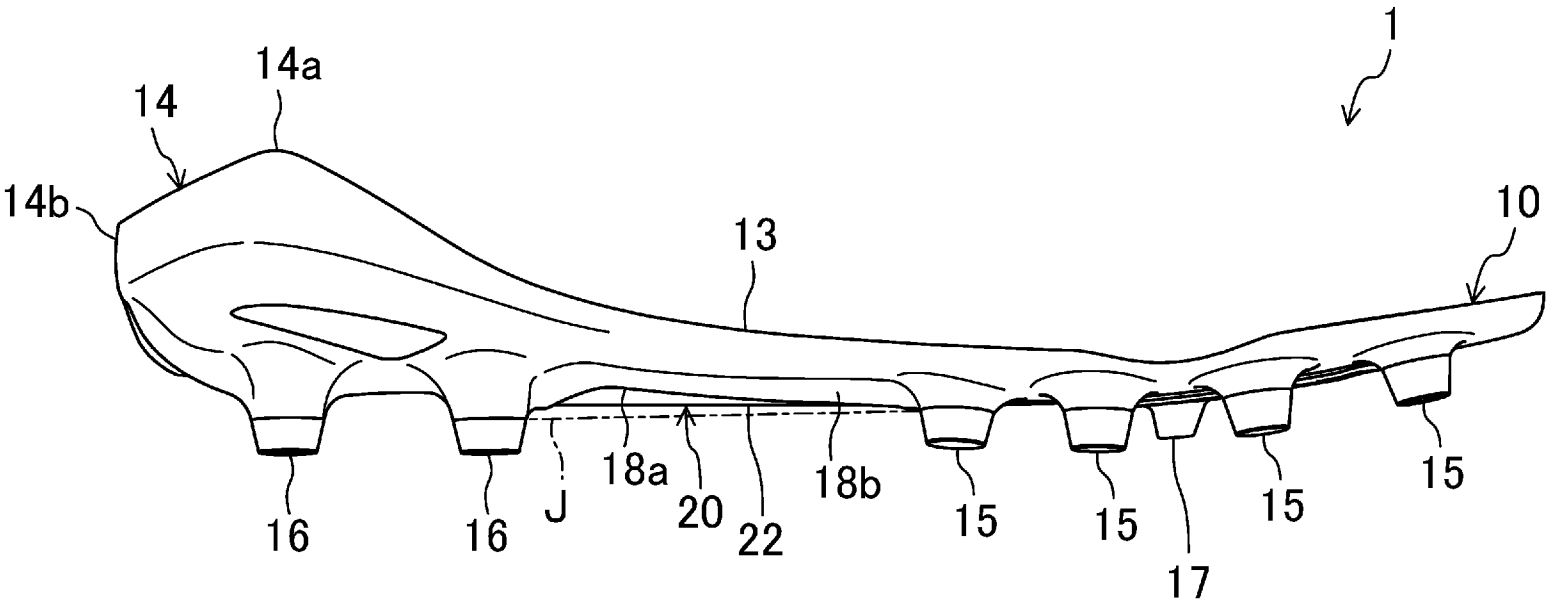
FIG. 5 is a left side view of the shoe outsole according to the embodiment of the present invention.
Figure 6:
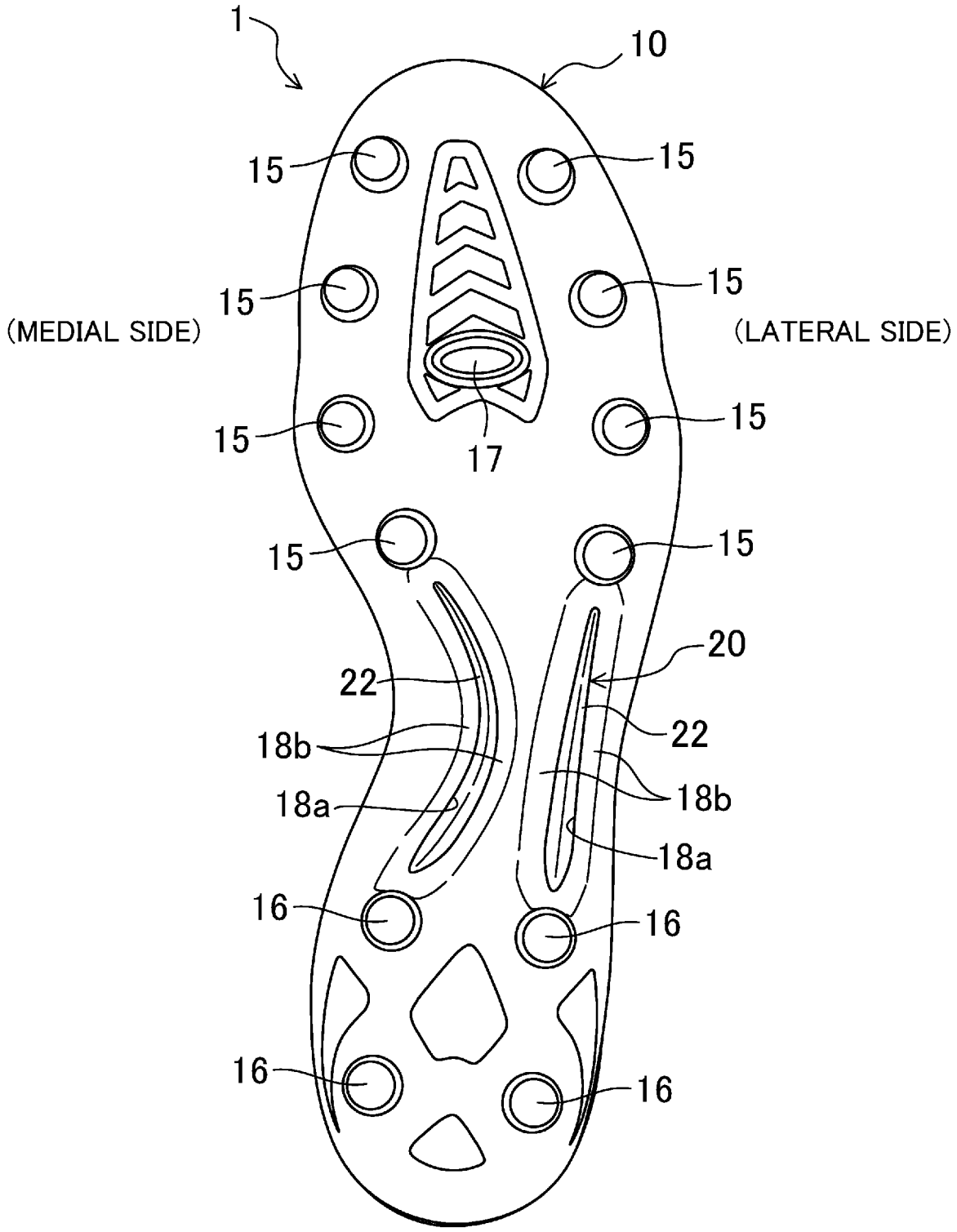
FIG. 6 is a bottom view of the shoe outsole according to the embodiment of the present invention.
Figure 7:
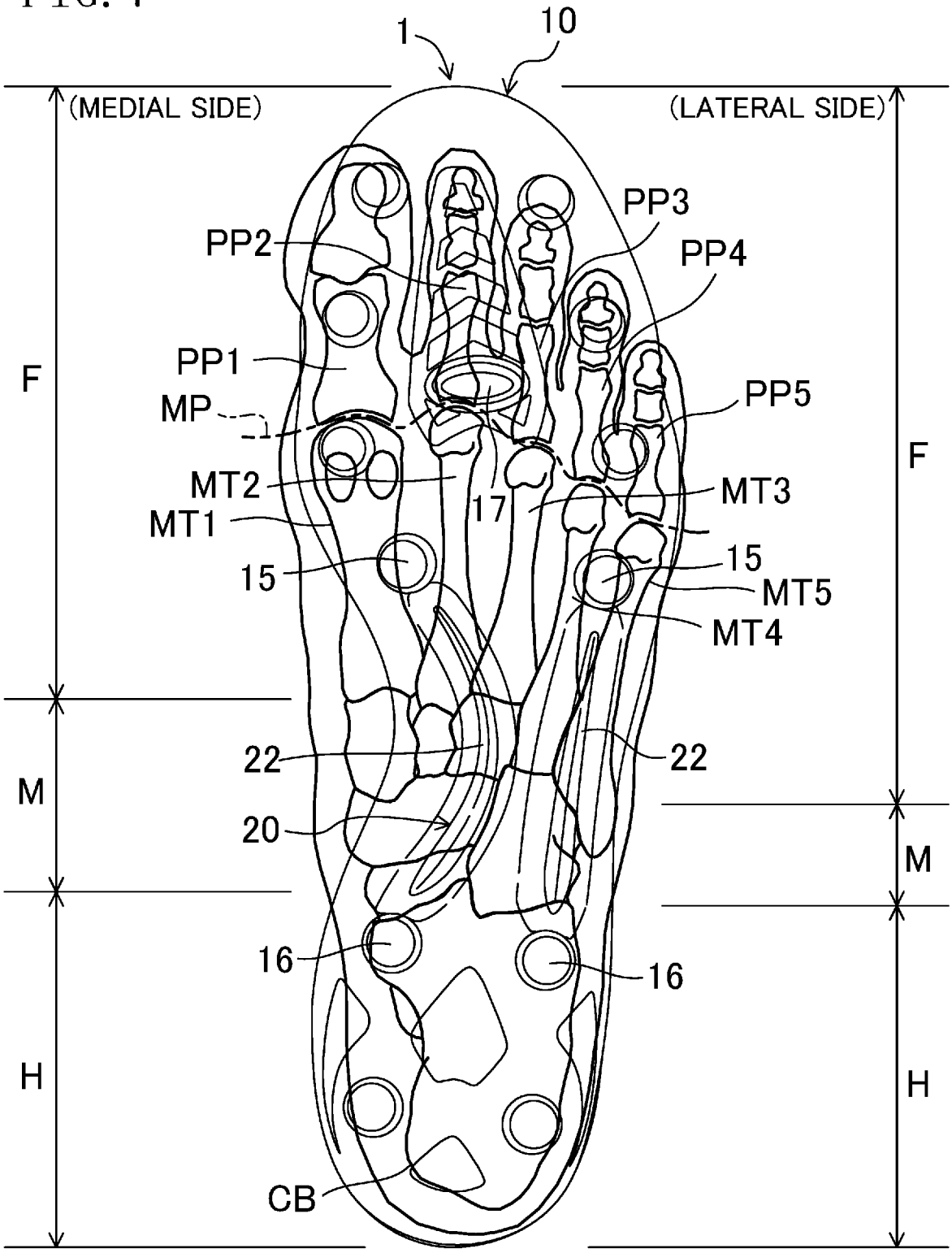
FIG. 7 is a bottom view schematically showing a positional relationship between the outsole and the skeleton structure of a foot.

As shown in FIGS. 5 to 7, in an area of the first outsole component 10 corresponding to a region continuous from a rear portion of the forefoot F to the midfoot M, rib penetration holes 18*a*, 18*a* which are configured to allow ribs 22, 22 (which will be described later) to project downward extend in the longitudinal direction. Further, rib-holding portions 18*b*, 18*b*, . . . which are downward protrusions are provided adjacent to the rib penetration holes 18*a*, 18*a*. The rib-holding portions 18*b*, 18*b*, . . . sandwich and press the rib 22, 22 therebetween in the width direction (see FIGS. 9 and 10).

In an area, of the bottom surface of the first outsole component 10, corresponding to the forefoot F, a plurality of (in this embodiment, eight) first studs 15, 15, . . . , each of which has the shape of a circular column projecting downward, are arranged dispersedly. Specifically, the first studs 15, 15, . . . are arranged in left and right portions (near medial side and lateral side). Pairs each including the left and right first studs 15, 15, are arranged at predetermined intervals in the longitudinal direction.

Moreover, a third stud 17 having a substantially elliptical shape in bottom view is provided at a position corresponding to a substantial center of the forefoot F (i.e., near the second and third proximal phalanx PP2 and PP3 in FIG. 7).

In another area, of the bottom surface of the first outsole component 10, corresponding to the hindfoot H, a plurality of (in this embodiment, four) second studs 16, 16, . . . , each of which has the shape of a circular column projecting downward, are arranged dispersedly. Specifically, the second studs 16, 16, . . . are arranged in left and right portions (near medial side and lateral side). Pairs each including the left and right second studs 16, 16, are arranged at predetermined intervals in the longitudinal direction.

Each of the first to third studs 15, 16, and 17 is made of a resin material having high wear resistance, such as thermoplastic polyurethane. Furthermore, as shown in FIG. 9, the first and second studs 15, 16 are formed by, for example, injection molding so as to be integral with the bottom surface of the first outsole component 10, and arranged to correspond to the positions of the round recesses 12, 12, . . . of the first outsole component 10. The thus configured first to third studs 15, 16, and 17 enhance ground-gripping capability of the outsole 1.

Next, as shown in FIGS. 1 to 3, the outsole 1 of the present invention includes, as a feature, a second outsole component 20 configured to support a region, of the plantar surface, which excludes the metatarsophalangeal joints MP, i.e., a region which is continuous from a rear portion, of the forefoot F, located rearward of the metatarsophalangeal joints MP to the hindfoot H. The second outsole component 20 is made of a hard resin material which has a higher rigidity than the first outsole component 10. Examples of the resin material for the second outsole component 20 include nylon containing glass fibers. In other words, the second outsole component 20 has a higher flexural rigidity than the first outsole component 10, and resists deformation even an external force is applied thereto.

Figure 8:
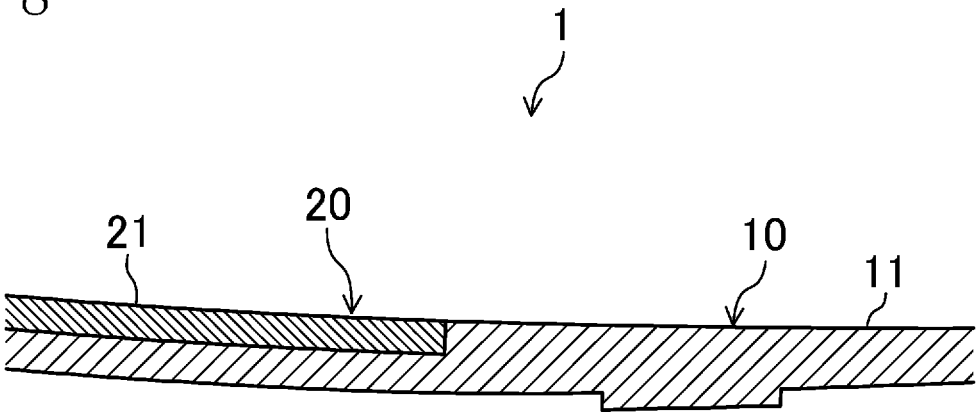
FIG. 8 is an enlarged cross-sectional view taken along line VIII-VIII of FIG. 2.

The second outsole component 20 includes a second planta-contact surface 21 which is configured to contact a region, of the plantar surface, which is continuous from a rear portion, of the forefoot F, located rearward of the metatarsophalangeal joints MP to the hindfoot H. As shown in FIG. 8, the second outsole component 20 is integrally formed on top of the first outsole component 10 by, for example, injection molding such that the second planta-contact surface 21 is flush with the first planta-contact surface 11 of the first outsole component 10. Specifically, in the outsole 1 of this embodiment, the first planta-contact surface 11 of the first outsole component 10 that is made of a deformable soft resin material is exposed at an area of the top surface of the outsole 1 corresponding to the region which includes the metatarsophalangeal joints MP and is continuous from the substantial center in the longitudinal direction of the forefoot F to the front end of the forefoot F. On the other hand, the second planta-contact surface 21 of the second outsole component 20 that is made of a hard resin material having a high rigidity is exposed at an area of the top surface of the outsole 1 corresponding to the region which is continuous from the rear portion, of the forefoot F, located rearward of the metatarsophalangeal joints MP to the hindfoot H.

As shown in FIG. 3, a front portion of the second outsole component 20 is located, in the longitudinal direction, in an area corresponding to a region which is continuous from substantial centers in the longitudinal direction of the first to fifth metatarsals MT1-MT5 to the distal condyles of the first to fifth metatarsals MT1-MT5. Moreover, the front portion of the second outsole component 20 extends, in the width direction, from a left side to a right side of the first outsole component 10 so as to support the first to fifth metatarsals MT1-MT5.

Figure 10:
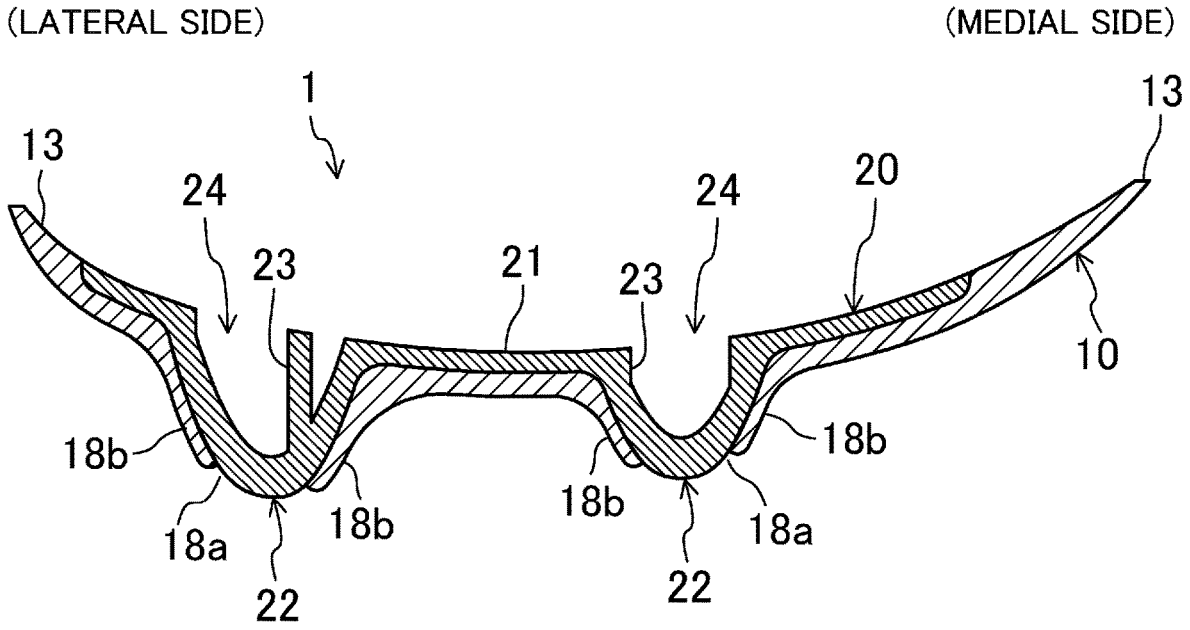
FIG. 10 is an enlarged cross-sectional view taken along line X-X of FIG. 2.

As shown in FIGS. 5 to 7, a pair of left and right ribs 22, 22 projects from the bottom surface of the first outsole component 10. The pair of ribs 22, 22 extends in the longitudinal direction in an area corresponding to a region which is continuous from a rear portion, of the forefoot F, located rearward of the metatarsophalangeal joints MP to the midfoot M. As shown in FIGS. 9 and 10, each of the ribs 22, 22 is constituted by a portion, of the second outsole component 20, which protrudes downward and penetrates the first outsole component 10 to project downward with respect to the first outsole component 10. More specifically, each of the ribs 22, 22 is configured to protrude downward through an associated one of the rib penetration holes 18*a*, 18*a* of the first outsole component 10 so as to have its lower end located below the first outsole component 10. The ribs 22, 22 each constituted by a portion of the second outsole component 20 can have a larger height from the planta support surface (in this embodiment, the second planta-contact surface 21) of the outsole 1 than typical ribs which could be provided as separate members to the bottom surface of the first outsole component 10. Thus, the ribs 22, 22 contribute to reduction of the weight of the whole outsole 1 and improvement of the flexural rigidity of the second outsole component 20.

As shown in FIGS. 5 and 9, each of the ribs 22, 22 is provided such that its lower end is positioned above a junction position J which connects the junction between the first outsole component 10 and the rearmost first stud 15 to the junction between the first outsole component 10 and the foremost second stud 16 (see the dot-dash line in FIGS. 5 and 9). This configuration makes it possible to ensure that each of the ribs 22, 22 has as much a projection height as possible and to prevent the gripping capability of the first and second studs 15, 16 from being impaired. As shown in FIGS. 6 and 10, each of the ribs 22, 22 is firmly held on the first outsole component 10, by being sandwiched between, and pressed by, the rib-holding portions 18*b*, 18*b* of the first outsole component 10 in the width direction.

Moreover, as shown in FIGS. 1 to 3, a honeycomb structure 24 is formed inside (the recess of) each rib 22. The honeycomb structure 24 is comprised of a plurality of partition walls 23, 23, . . . which are in contact with each other and define recesses each having a regular hexagonal shape and recessed downward from the second planta-contact surface 21 of the second outsole component 20 (see FIG. 10). The honeycomb structure 24 makes the inside of each rib 22 substantially hollow and contributes not only to reduction of the weight of the rib 22, but also to further enhancement of the flexural rigidity of the area corresponding to a region which is continuous from the rear portion, of the forefoot F, located rearward of the metatarsophalangeal joints MP to the midfoot M. Note that for the sake of convenience, the partition walls 23, 23, . . . are omitted from the honeycomb structures 24, 24 shown in FIG. 9.

As shown in FIGS. 6 and 7, the rib 22 provided closer to the medial side extends in the longitudinal direction between the first stud 15 that is closer to the medial side and arranged in a rearmost portion, of the forefoot area F, located rearward of the metatarsophalangeal joints MP, and the second stud 16 that is closer to the medial side and arranged in a foremost portion of the hindfoot area H. The rib 22 is curved such that its central portion bulges toward the lateral side from the medial side. The other rib 22 provided closer to the lateral side extends substantially linearly in the longitudinal direction between the first stud 15 that is closer to the lateral side and arranged in the rearmost portion, of the forefoot area F, located rearward of the metatarsophalangeal joints MP, and the second stud 16 that is closer to the lateral side and arranged in the foremost portion of the hindfoot area H. In addition, each of the ribs 22, 22 is configured such that its central portion is positioned near the proximal condyles of the first to fifth metatarsals MT1-MT5.

Here, as shown in FIGS. 1 to 3, the front end of the second outsole component 20 overlaps with the first studs 15, 15 that are located rearward of the metatarsophalangeal joints MP, in plan view. More specifically, as shown in FIG. 9, the front end of each of the honeycomb structures 24, 24 formed inside the ribs 22, 22 covers a semicircular portion located rearward of a substantial center of the associated one of the round recesses 12, 12 of the first outsole component 10 that correspond to the positions of the first studs 15, 15 arranged in the rearmost portion of the forefoot area F. On the other hand, the rear end of each of the honeycomb structures 24, 24 covers a semicircular portion located frontward of a substantial center of the associated one of the round recesses 12, 12 of the first outsole component 10 that correspond to the positions of the second studs 16, 16 arranged in the foremost portion of the hindfoot area H. In other words, the ribs 22, 22 are continuous with the first studs 15, 15 that are located rearward of the metatarsophalangeal joints MP and in the rearmost portion of the forefoot area F, and with the second studs 16, 16 that are located in the foremost portion of the hindfoot area H.

The second outsole component 20 has semicircular holes 25, 25 which correspond to the rear semicircular portions of the round recesses 12 and are adjacent to the rear ends of the honeycomb structures 24, 24. The second outsole component 20 further has, at positions corresponding to the second studs 16, 16 arranged in the rearmost portion of the hindfoot area H, circular holes 26, 26 each of which has the same size as the round recesses 12, 12 of the first outsole component 10.

Figure 11:
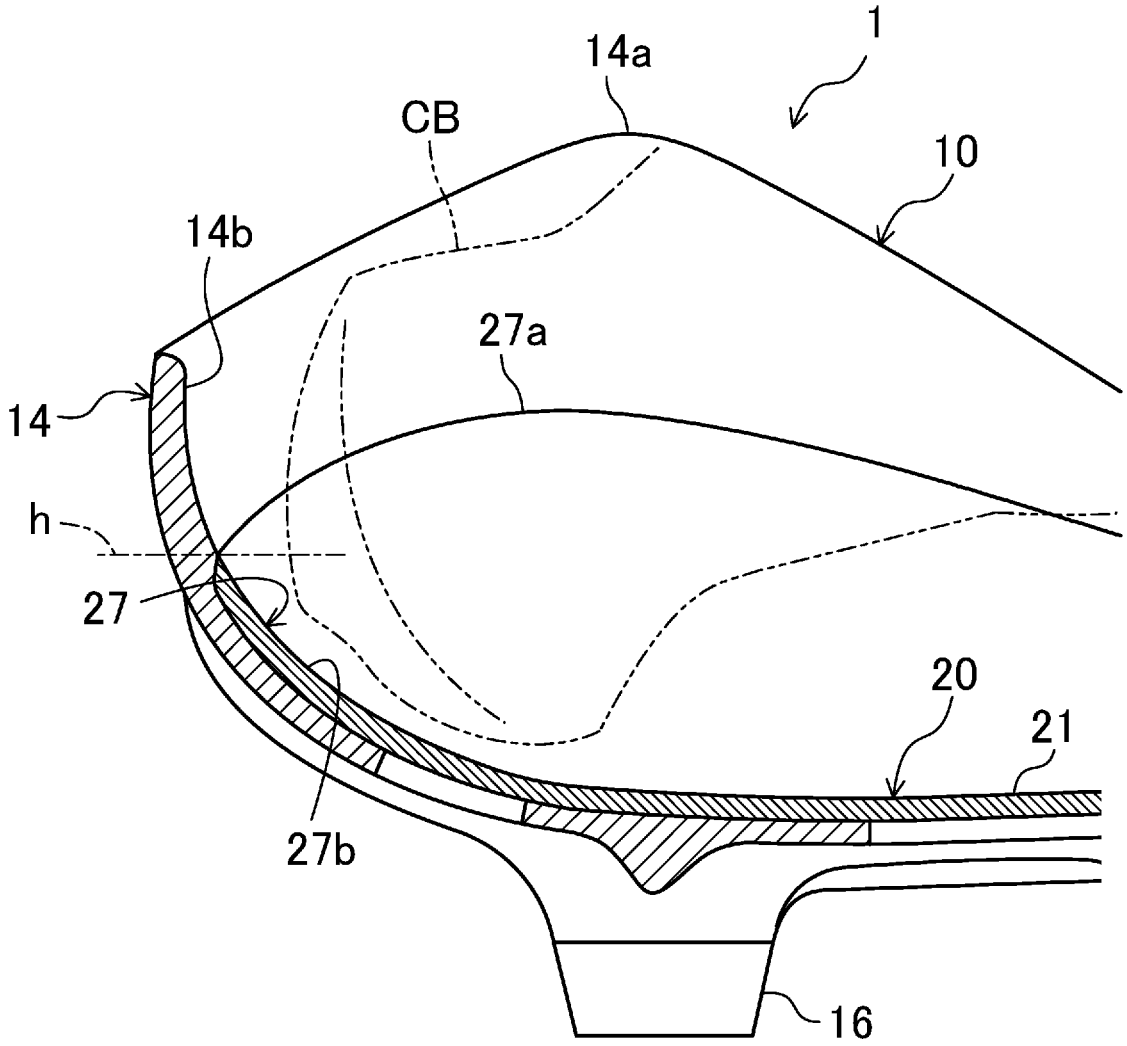
FIG. 11 is an enlarged cross-sectional view taken along line XI-XI of FIG. 4.

As shown in FIGS. 1 to 3, the second outsole component 20 includes, in its rear portion, a heel support portion 27 which is continuous with the counter portion 14 and configured to support a bottom portion of the calcaneus CB (heel). As shown in FIG. 11, the heel support portion 27 is integrally formed on top of the counter portion 14 such that the surface of the heel supporter portion 27 is flush with the surface of the counter portion 14. The heel support portion 27 has, at its left and right parts, side wall portions 27*a*, 27*a* which project upward and are configured to cover the left and right sides of a lower portion of the calcaneus CB. The heel support portion 27 further has, at its rear part, a rear wall portion 27*b* which is continuous with the side wall portions 27*a*, 27*a* and configured to cover a rear side of the lower portion of the calcaneus CB.

The heel support portion 27 extends upward to have its top end positioned lower than the top end of the counter portion 14. More specifically, as shown in FIG. 11, the rear wall portion 27*b* of the heel support portion 27 extends upward such that its top end reaches a rearmost point of a bulge of the calcaneus CB in side view (i.e., the position indicated by the dot-dash line h in FIG. 11). The top end of each side wall portion 27*a* of the heel support portion 27 is above the top end of the rear wall portion 27*b*.

As can be seen from the foregoing description, with the shoe outsole 1 according to this embodiment, in the area corresponding to the region that includes the metatarsophalangeal joints MP and is continuous from the substantial center in the longitudinal direction of the forefoot F to the front end of the forefoot F, the first outsole component 10 made of a deformable soft resin material allows the joints in the forefoot F (especially, the metatarsophalangeal joints MP) to be bent flexibly during exercise. On the other hand, in the area corresponding to the region that is continuous from the rear portion, of the forefoot F, located rearward of the metatarsophalangeal joints MP to the hindfoot H, the second outsole component 20 made of a hard resin material which has a higher rigidity than the first outsole component 10 can reduce an impact applied to the foot at the time of an instantaneous motion such as a change in direction and stabilize the region from the rear portion of the forefoot F to the hindfoot H inside the shoe, while maintaining a sufficient flexural rigidity. In the outsole 1 of this embodiment, the configuration in which the second outsole component 20 is integrally formed on top of the first outsole component 10 makes it possible to obtain both the advantages for the region including metatarsophalangeal joints MP and continuous from the substantial center in the longitudinal direction of the forefoot F to the front end of the forefoot F, and the advantages for the region continuous from the rear portion, of the forefoot F, located rearward of the metatarsophalangeal joints MP to the hindfoot H.

The front portion of the second outsole component 20 is located in an area corresponding to a region which is continuous from a substantial center in the longitudinal direction of the first to fifth metatarsals to the distal condyles of the first to fifth metatarsals, and extends from the left side to the right side of the first outsole component 10 to support the first to fifth metatarsals MT1-MT5. As a result, the first outsole component 10 can maintain a state where especially the metatarsophalangeal joints MP are easily bent, while the second outsole component 20 having a high rigidity can stabilize the first to fifth metatarsals MT1-MT5 inside the shoe.

In plan view, the front end of the second outsole component 20 overlaps with the first studs 15, 15 located rearward of the metatarsophalangeal joints MP. Therefore, the boundary between the first and second outsole components 10 and 20 is situated above the first studs 15, 15 located rearward of the metatarsophalangeal joints MP. That is, the boundary between the first and second outsole components 10 and 20 overlap with the first studs 15, 15 which can be deformed to very limited extent by bending. This makes it difficult for stresses to concentrate at the boundary between the first and second outsole components 10 and 20 having different rigidities. As a result, the second outsole component 20 is less likely to peel off the first outsole component 10 at this boundary.

According to this embodiment, the pair of left and right ribs 22, 22 constituted by portions of the second outsole component 20 having a high rigidity contributes not only to reduction of the weight of the whole outsole 1, but also to enhancement of the flexural rigidity of the area corresponding to the region continuous from the rear portion, of the forefoot F, located rearward of the metatarsophalangeal joints MP to the midfoot M. This makes it possible to reduce a physical stress applied to the region, of a wearer's foot, which is continuous from a rear portion, of the forefoot F, located rearward of the metatarsophalangeal joints MP to the midfoot M.

In addition, each of the ribs 22, 22 has its central portion in the longitudinal direction located near the proximal condyles of the first to fifth metatarsals MT1-MT5, contributing to further enhancement of the flexural rigidity of an area corresponding to a vicinity of the proximal condyles of the first to fifth metatarsals MT1-MT5. This makes it possible to reduce a physical stress which can be applied to the vicinity of the proximal condyles of the metatarsals MT (especially, the proximal condyle of the fifth metatarsal MT5) of a wearer due to repetition of motion of reducing the wearer's running speed using his/her forefoot F and twisting his/her forefoot for change in running direction.

In plan view, the ribs 22, 22 have the front ends overlapping with the first studs 15, 15 that are located rearward of the metatarsophalangeal joints MP and in the rearmost portion of the forefoot area F, and the rear ends overlapping with the second studs 16, 16 that are located in the foremost portion of the hindfoot area H. In other words, the ribs 22, 22 are continuous with the first studs 15, 15 that are located rearward of the metatarsophalangeal joints MP and in the rearmost portion of the forefoot area F, and with the second studs 16, 16 that are located in the foremost portion of the hindfoot area H. This configuration contributes to further enhancement of the flexural rigidity of the midfoot area M in particular.

Moreover, according to this embodiment, the heel support portion 27 can stabilize a lower portion of the calcaneus CB (heel). Furthermore, the counter portion 14 having a low rigidity holds the periphery of the heel softly. This can reduce a risk of appearance of pain in the wearer's foot.

OTHER EMBODIMENTS

In the embodiment described above, the front end of the rib 22 closer to the medial side overlaps with the first stud 15 located in the rearmost portion of the forefoot area F in plan view. However, the present invention is not limited to this embodiment. For example, the front end of the rib 22 closer to the medial side may overlap with the third foremost first stud 15 that is arranged closer to the medial side in the forefoot area F as shown in FIGS. 1 to 3. In short, it is suitable that the front end of the second outsole component 20 overlaps with any one of the first studs 15 located rearward of the metatarsophalangeal joints MP in plan view.

The embodiment described above includes the counter portion 14 and the heel support portion 27. However, the present invention is not limited to this embodiment. Specifically, the outsole 1 (outsole structure) may include a first outsole component 10 having no counter portion 14 and a second outsole component 20 having no heel support portion 27.

Note that the present invention is not limited to the embodiments described above, and various changes and modifications may be made without departing from the scope of the present disclosure.

INDUSTRIAL APPLICABILITY

The present invention is industrially applicable, for example, as a cleated shoe for sports in which a player need to move instantaneously, such as soccer, rugby, America football, and baseball.

DESCRIPTION OF REFERENCE CHARACTERS

1: Outsole (Shoe Outsole Structure)
10: First Outsole Component
14: Counter Portion
15: First Stud
16: Second Stud
20: Second Outsole Component
22: Rib
24: Honeycomb Structure
27: Heel Support Portion
F: Forefoot
M: Midfoot
H: Hindfoot
MP: Metatarsophalangeal Joints
PP: Proximal Phalanx
MT: Metatarsal
CB: Calcaneus (Heel)

The invention claimed is:

1. A shoe outsole structure for supporting a plantar surface of a wearer, the shoe outsole structure comprising:

a first outsole component made of a deformable soft resin material and configured to entirely support the plantar surface spreading from a forefoot to a hindfoot; and a second outsole component integrally formed on top of the first outsole component, made of a hard resin material which has a higher rigidity than the first outsole component, located at a position corresponding to the plantar surface in a region continuous from a rear portion, of the forefoot, located rearward of metatarsophalangeal joints to the hindfoot, and configured to support the plantar surface in the region, a plurality of first studs are arranged dispersedly in an area, on a bottom surface of the first outsole component, which corresponds to a forefoot area of a foot of the wearer, and in plan view, a front end of the second outsole component overlaps with at least one of the first studs located in a region, of the first outsole component, which corresponds to a region rearward of the metatarsophalangeal joints of the foot of the wearer.

2. The shoe outsole structure of claim 1, wherein a front portion of the second outsole component is located in an area corresponding to a region which is continuous from a substantial center in a longitudinal direction of first to fifth metatarsals to distal condyles of the first to fifth metatarsals, and extends from a left side to a right side of the first outsole component so as to support the first to fifth metatarsals.

3. A shoe comprising the shoe outsole structure of claim 2.

4. The shoe outsole structure of claim 1, wherein a pair of left and right ribs extending in a longitudinal direction is provided in an area of the first outsole component corresponding to a region which is continuous from the portion, of the forefoot, located rearward of the metatarsophalangeal joints to a midfoot, and each rib is constituted by a portion, of the second outsole component, which penetrates the first outsole component so as to project from a bottom surface of the first outsole component.

5. A shoe comprising the shoe outsole structure of claim 4.

6. The shoe outsole structure of claim 4, wherein each of the pair of left and right ribs has a central portion in a longitudinal direction positioned at a region, of the first outsole component, which corresponds to a region near proximal condyles of first to fifth metatarsals of the foot of the wearer.

7. A shoe comprising the shoe outsole structure of claim 6.

8. The shoe outsole structure of claim 6, wherein a plurality of second studs are arranged dispersedly in an area, on a bottom surface of the first outsole component, which corresponds to a hindfoot area of the foot of the wearer, and in plan view, each of the pair of left and right ribs has a front end overlapping with an associated one of the first studs that is located in a region, of the first outsole component, which corresponds to a region rearward of the metatarsophalangeal joints of the foot of the wearer and is located in a rearmost portion of the forefoot area, and in plan view, each of the pair of left and right ribs has a rear end overlapping with an associated one of the second studs that is located in a foremost portion of the hindfoot area.

9. A shoe comprising the shoe outsole structure of claim 6.

10. The shoe outsole structure of claim 1, wherein a counter portion rises from left, right, and rear sides of the first outsole component so as to cover a heel, and from a rear portion of the second outsole component, a heel support portion extends upward to have a top end positioned lower than a top end of the counter portion so as to support a lower portion of the heel.

11. A shoe comprising the shoe outsole structure of claim 10.

12. A shoe comprising the shoe outsole structure of claim 1.

* * * * *